US010837167B2

(12) United States Patent
Nitunga

(10) Patent No.: US 10,837,167 B2
(45) Date of Patent: Nov. 17, 2020

(54) CONSTRUCTION OF THE PREFABRICATED COLUMN AND BEAM TYPE

(71) Applicant: Libere Nitunga, Bu (BI)

(72) Inventor: Libere Nitunga, Bu (BI)

( * ) Notice: Subject to any disclaimer, the term of this patent is extended or adjusted under 35 U.S.C. 154(b) by 0 days.

(21) Appl. No.: 16/695,309

(22) Filed: Nov. 26, 2019

(65) Prior Publication Data

US 2020/0131755 A1 Apr. 30, 2020

Related U.S. Application Data

(63) Continuation-in-part of application No. 15/571,047, filed as application No. PCT/IB2016/053064 on May 25, 2016, now Pat. No. 10,494,807.

(51) Int. Cl.

| | |
|---|---|
| ***E04B 1/24*** | (2006.01) |
| ***E04B 1/21*** | (2006.01) |
| ***E04B 5/10*** | (2006.01) |
| ***E04H 9/02*** | (2006.01) |
| ***E04B 1/26*** | (2006.01) |

(52) U.S. Cl.

CPC ..... *E04B 1/2403* (2013.01); *E04B 1/215* (2013.01); *E04B 1/2604* (2013.01); *E04B 5/10* (2013.01); *E04H 9/024* (2013.01); *E02D 2600/20* (2013.01); *E04B 2001/2424* (2013.01); *E04B 2001/2457* (2013.01)

(58) Field of Classification Search

CPC ..... E04B 1/2404

See application file for complete search history.

(56) References Cited

U.S. PATENT DOCUMENTS

| | | | | |
|---|---|---|---|---|
| 4,285,176 | A * | 8/1981 | Runkle | E04B 1/26 52/234 |
| 9,562,351 | B2 * | 2/2017 | Ibrahim | E04B 1/2604 |
| 2006/0112657 | A1 * | 6/2006 | Abbot-Wilcox | E04B 1/2604 52/633 |
| 2008/0245023 | A1 * | 10/2008 | Simmons | E04B 1/24 52/655.1 |
| 2014/0182235 | A9 * | 7/2014 | Yang | E04B 1/24 52/704 |

* cited by examiner

*Primary Examiner* — Babajide A Demuren

(74) *Attorney, Agent, or Firm* — KA Filing LLC; Cynthia Ward Flanigan

(57) ABSTRACT

A system of construction that performs advanced prefabrication of columns—beams type structure of buildings, prefabrication which results industrialization of this type of construction. The main development that allows this achievement in the same technical conditions, even better conditions than in the conventional system, is the massive use of braces as well vertically as horizontally. Such a building system is of special interest in areas where seismic risk is high because the building is very lightweight, constituted of a set of structurally self-sufficient units, heavily triangulated and therefore hardly deformable, all these at an affordable cost.

10 Claims, 8 Drawing Sheets

CONSTRUCTION OF THE PREFABRICATED COLUMN AND BEAM TYPE

TECHNICAL FIELD OF THE DISCLOSURE

The present invention relates to prefabricate columns and beams construction type, be it of wood, concrete or any other material.

BACKGROUND ART OF THE DISCLOSURE

The buildings made of separate columns and beams are rare, because it is more advantageous to make horizontal and vertical chaining in one piece for each floor, in as much as possible: reinforcement bars and casting concrete.

On the other hand, in the wooden construction domain, separate columns and beams are experiencing widespread use. They are always prefabricated and transported on construction sites to be assembled with various metallic accessories.

SUMMARY OF THE DISCLOSURE

A method for construction of a building structure, comprising: assembling at least one peripheral junction by connecting prefabricated columns and beams via braces and rods, wherein each of the columns and beams comprises a plurality of notches and holes along each of the column and beam, and, wherein each of braces comprises complementary wedges along end portions to match with notch of the respective column and beam of the plurality of columns and beams, and holes to concede with the holes of the beams and the columns, and wherein the rods are threaded rods to be inserted in the concede holes of columns and beams, and the braces; and assembling at least one central junction by connecting one of prefabricated metallic frames and/or prefabricated connection blocks along the end portion of each of the columns and beams.

In one example, each of the columns and beams comprises a connecting arrangement along at least one end portion of each of the column and beam.

In one example, the connecting arrangement is a plurality of starting bars.

In one example, connecting the prefabricated metallic frames along the end portion of each of the columns and beams includes welding the prefabricated metallic frames with the plurality of starting bars.

In one example, connecting the prefabricated metallic frames along the end portion of each of the columns and beams including pouring the concrete mixture along the welded prefabricated metallic frames and the plurality of starting bars.

In one example, the connecting arrangement is a connector assembly.

In one example, the method further connecting the prefabricated connection blocks along the end portion of each of the columns and beams comprises connecting the connector assembly at the end portion of each of the columns and beams with the prefabricated connection blocks.

A method for construction of a building structure, including: prefabricating a plurality of columns and beams, and a plurality of braces, at a factory site, wherein each column and beam of the plurality of columns and beams, comprise, a plurality of starting bars or a connector assembly along at least one end portion of each of the column and beam, and a plurality of notches along each of the column and beam, wherein each brace of the plurality of braces comprises complementary wedges along end portions thereof to match with notch of the respective column and beam of the plurality of columns and beams; assembling a double junction between columns and beams, wherein assembling the double junction comprises, assembling a peripheral junction by connecting the plurality of braces or the connector assembly with the columns to adjacent beams, and connecting the plurality of braces to adjacent beams by the respective notches and the complementary wedges, and assembling a central junction of reinforced concrete, at an intersection between columns and beams along the respective end portions thereof with the plurality of starting bars or the connector assembly, the central junction comprises a plurality of prefabricated metallic frames and connection blocks for reinforcement of the central junction, the prefabricated metallic frames to be welded with the starting bars of the beams, or the connector assembly to be connected with the connection blocks, while the columns bottoms with respective starting bars respective ends thereof or the columns bottoms with the connector assembly to be connected with the connection blocks for assembling with a foundation or with the columns of a lower floor of the building, and pouring concrete in the central junctions and along the bottom of the columns of one or more floors, while the prefabricated columns and beams along the peripheral junction, and, the metallic frames welded along the central junction, on the construction site held the building structure.

In one example, the connection blocks and the metallic frames are prefabricated at the factory site.

The method further includes laterally placing movable provisional supports at the top of the columns, in order to support beams while braces are being fixed thereto.

The method further includes pouring sealing agent in a space between the plurality of beams, columns and braces to contribute in bonding therebetween.

The method further includes constructing an anti-sliding assembly in a form of slight tenon and mortise, notches, wedges and lugs along each of the columns, beams and braces.

A building structure comprising: at least one peripheral junction formed by prefabricated columns and beams connected via braces and rods, wherein each of the columns and beams comprises a plurality of notches and holes along each of the column and beam, and, wherein each of braces comprises complementary wedges along end portions to match with notch of the respective column and beam of the plurality of columns and beams, and holes to concede with the holes of the beams and the columns, and wherein the rods are threaded rods to be inserted in the concede holes of columns and beams, and the braces; and at least one central junction formed by one of prefabricated metallic frames and/or prefabricated connection blocks connected along the end portion of each of the columns and beams.

In one example each of the columns and beams comprises a connecting arrangement along at least one end portion of each of the column and beam.

In one example wherein the connecting arrangement is a plurality of starting bars.

In one example, the prefabricated metallic frames is welded to the plurality of starting bars along the end portion of each of the columns.

In one example, the prefabricated metallic frames welded to the plurality of starting bars the end portion of each of the columns and beams is con sealed by a concrete mixture.

In one example, the connecting arrangement is a connector assembly.

In one example, the prefabricated connection blocks along the end portion of each of the columns and beams is connected with the connector assembly.

In one example, the plurality of notches comprises an inner notch and an outer notch configured along inner and outer sides of each of the columns and beams, the inner side and the outer side are in respect with the central junctions, the sides facing the central junction are the inner sides, while the other are the outer sides, wherein the inner notch is longer than the outer notch.

In one example, a section of the same junction beam-brace, where the notch provided in the column or in the beam has an angle inferior to 90°.

In one example, a building structure includes at least one peripheral junction, at least one central junction and a plurality of walls and floors. The at least one peripheral junction is formed by prefabricated columns and beams connected via braces and rods. Further, the at least one central junction is formed by one of prefabricated metallic frames and/or prefabricated connection blocks connected along the end portion of each of the columns and beams. The at least one central junction may include at least one enlarged section configured along at least one of a corner portions of the central junction. Furthermore, the plurality of walls and floors are configured and supported via the at least one peripheral junction and the at least one central junction. Each of the walls and floors of the plurality of walls and floors includes corners. The at least one enlarged section is configured along at least one of a corner portions of the central junction coincides with the corners of each of the walls and floors of the plurality of walls and floors.

In one embodiment, at least one central junction includes a central portion having four sides, and a peripheral portion extending from all the four sides, wherein each of the peripheral portion and the central portion comprises at least one hole. Further, the at least one enlarged section may extend between the two adjacent peripheral portions, wherein each of the at least one enlarged section also comprises at least one hole. Furthermore, the holes of the enlarged section, the central and the peripheral portions cooperate with respective corresponding holes of the columns and beams, and the walls and floors.

In one embodiment, the building structure may include assembling rods to engage with the cooperated holes of the enlarged section, central and peripheral portions cooperate with respective corresponding holes of the columns and beams, and the walls and floors.

DESCRIPTION OF THE DISCLOSURE

Figure 1:
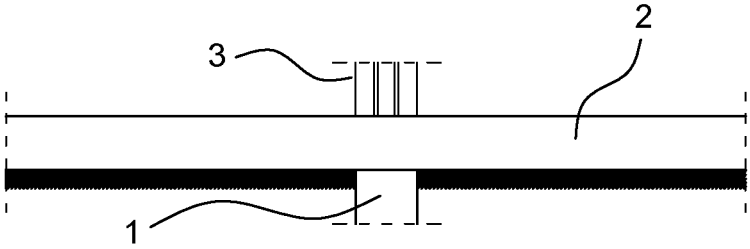
FIG. 1 illustrates a section of the foundation and the low ring beam of a building under construction, in accordance with an exemplary embodiment of the present disclosure.

The present invention relates to a technique for construction of buildings made of wood, reinforced concrete or any other material, which consists of using factory prefabricated columns and beams, and realizing their connection on construction site, firstly by a system of vertical and horizontal braces, and secondly by a reinforced concrete junction at their intersection. A central role is played by the braces that securely hold the columns and beams in their final position as soon as they are fixed. They realize a connection that we call peripheral connection, to distinguish it from the central connection made at the intersection of the said columns and beams.

Threaded rods are the most adequate way for assembling braces to columns and beams.

The central junction may itself be cast on site; then we have partial prefabrication, or be prefabricated, and then we have total prefabrication. The contact surface between braces and the columns or beam can be simple, without any special provision. In this case, if there is a force which tends to open or close the angle made of column and beam, the brace will play its role by opposing itself against this action.

But in order to impede the brace from sliding along the column or beam, the assembling threaded rod will be subject of shearing forces and accordingly, must be of great section. In order to remedy this problem, various asperities are provided on contact surfaces, a notch in the column or beam, in which comes a wedge provided at the end of the brace, etc. Such a system prevents any risk of sliding of a brace along column or beam, in case some force tending to modify the angle between column and beam. The outer notch prevents the closure of the said angle and the inner notch prevents its opening. For efficiency, the inner notch is longer than the outer notch, and may even form an acute angle with the axis of the post or beam.

In order to prevent, reduce or eliminate any space between the prefabricated elements, i.e. columns, beams, braces and junction blocks, but also to achieve a certain connection between the said elements, a seal under the form of cement mortar for example, is applied at the intersection of said elements.

We are not limited in the number or the inclination of bracing pieces, or in the number or type fastening them to columns or beams: bolts, pins, rivets, nails, etc. It is the same for the connection between the junction blocks and the ends of columns and beams described below.

(A) PARTIAL PREFABRICATION: CASTING THE JUNCTION ONSITE

Beams are factory prefabricated, with starting bars which will enter into the junctions.

Columns are provided at their bottom with a zone of about 20 cm with only starting bars, which will be cast with concrete on site at the time of their installation.

The top of the columns are provided with starting bars of sufficient length on the one hand to be part of the junction, and on the other hand to serve as starting bars for subsequent junction assembly of the column of the upper floor.

The columns and beams are securely held in their final position by braces in the horizontal and vertical direction. The ends of said columns and beams form a formwork for casting concrete into the junction.

At the time of posing beams for attaching braces on them, it is useful to firstly fix removable intermediate supports on the side top of columns, on which said beams will rest, which facilitates adjustment and fixing the braces on the said beams.

Insofar as the volume in which concrete will be cast on site in is reduced, we can afford to use a very high dosage of concrete, weld the reinforcement bars in the junction instead of the usual overlap, etc.

In a construction node enter many starting bars of column and adjacent beams. To position them can be a problem when construction is being carried out, because of their rigidity and the narrowness of the space they have to share. In order to address this issue, the junction reinforcement bars of the junction is prefabricated, either fully or partially. It can take the form of a metallic frame, preferably welded.

The columns and beams whose reinforcement entering into the junction is prefabricated are provided with small pieces of starting bars, on which will be welded the prefabricated reinforcement of the junction.

(B) TOTAL PREFABRICATION: PREFABRICATED JUNCTION BLOCKS

Here, a junction block with as many branches as there are adjacent columns and beams to the said node, is factory prefabricated. The branches of said junction block are tightly connect to the ends of the columns and beams adjacent to the node. The contact surface between the block and the column or the beam may be cut following an oblique line i.e. in bevel sharp, following a straight line, a broken line, i.e. in staircase, etc.

Junction blocks and the ends of columns and beams adjacent to the junction are manufactured in order to ensure them a high mechanical strength: additional reinforcement bars and maximum dosage of concrete.

The contact surfaces have deep grooves or other asperities, to prevent relative movement of the members being connected. The threaded rods are the most appropriate method for tightening columns and beams to the junction blocks.

Can also improve the strength of the connection between these elements by increasing the contact surface, on the one hand in the longitudinal direction to the columns and beams by increasing the length of the branches of prefabricated junction block, and on the other hand in the direction orthogonal to the columns and beams by increasing the width of said branches.

In the latter case, it is as if the prefabricated junction block has been cut from a building by cutting not only the columns and beams, but also the adjacent corners of walls and of floors.

Therefore, the ends of the columns and beams adjacent to the node take the form of T to match the dimensions and the sharp of the junction block.

The thickness of the various parts of the junction block must take into account the thickness of the ends of columns and beams it will be connected with, so that the total thickness is not too different from the thickness of columns and beams, for example 200 mm.

Thus, the central part of the terminal block, which is attached at either end of the column or beam keeps the thickness of the columns and beams, 200 mm in this example.

Areas of the junction block in contact with only one end of a column or of a beam, have a thickness of about 10 cm in this example, i.e. half the thickness of the building structure. The same applies, mutatis mutandis, to areas of the junction block which are in contact with two ends.

Naturally, the thickness of the end of a column or a beam must in its turn take into account the thickness of the other ends and the thickness of the branch of the junction block it will be in contact with, in order to have a total thickness of 200 mm in our example.

(C) CASE OF CONSTRUCTION MADE OF WOOD

Usually connection between columns and beams is generally done using various metallic fittings. But in the present invention, the junction is made of reinforced concrete. It then comes to firmly secure reinforcement bars at the ends of columns and beams, in order to have starting bars that will participate in the realization of the said junction.

The present invention also takes advantage of cross nailing for secure mounting of wooden braces to the wood columns and beams.

Areas that may crack or break up due to intensive nailing are surrounded by compression fittings. This will result also in increasing the pressure exercised upon nails, improving the strength of the connection.

(D) DESCRIPTION WITH REFERENCE TO DRAWINGS

FIG. 1 represents a section of the foundation and the low ring beam (2) of the building under construction.

FIG. 1 describes the building foundation (1), the low ring beam (2) and the starting bars for installing columns of the first level of the construction or ground floor (3).

Figure 2:
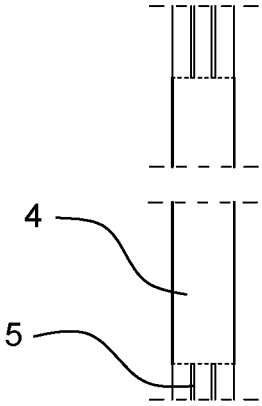
FIG. 2 illustrates a section of a column to be set up in case of partial prefabrication, in accordance with an exemplary embodiment of the present disclosure.

FIG. 2 represents a section of a column to be set up in case of partial prefabrication.

FIG. 2 describes the prefabricated area of the column to be set up (4), and the starting bars in the area of the column for which concrete will be cast on construction site (5).

Figure 3:
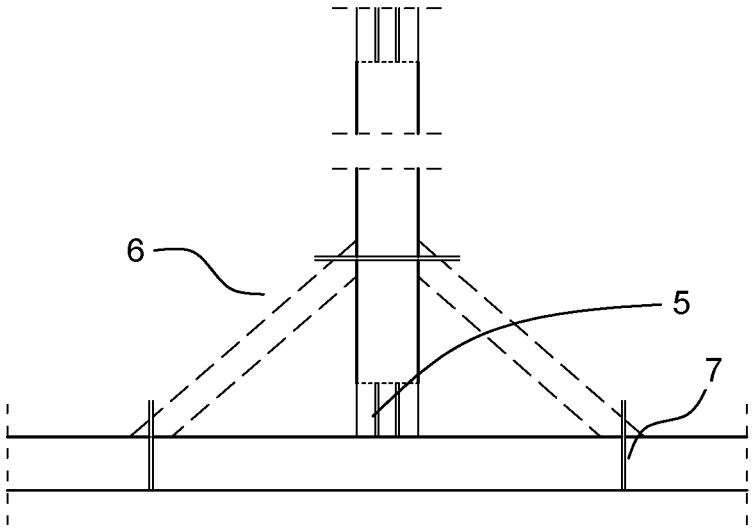
FIG. 3 illustrates a column being posed on the low ring beam, in accordance with an exemplary embodiment of the present disclosure.

FIG. 3 represents a column being posed on the low ring beam.

FIG. 3 describes starting bars from the foundation or from the lower floor and the ones from the column (5), the braces (6), as well as the threaded rods for assembling braces to columns and to beams (7).

Figure 4:
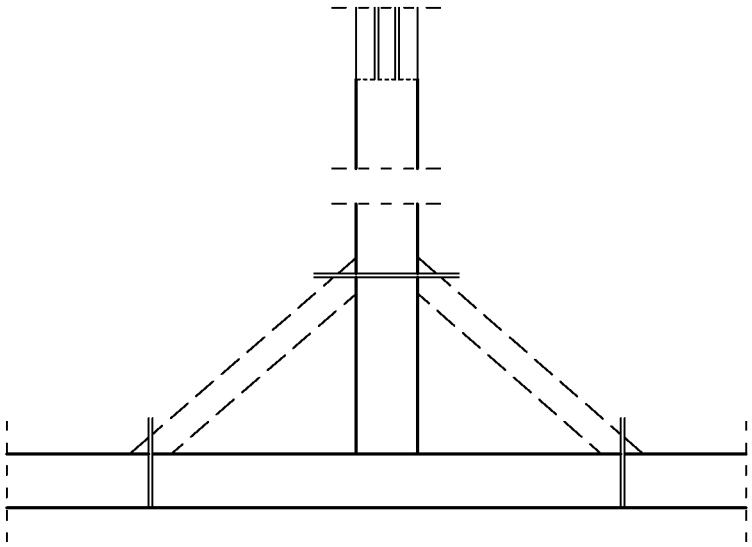
FIG. 4 illustrates a column whose junction with the low ring beam is already concrete cast: realization of the junction is finished, in accordance with an exemplary embodiment of the present disclosure.

FIG. 4 shows a column whose junction with the low ring beam is already concrete cast: realization of the junction is finished.

Figure 5:
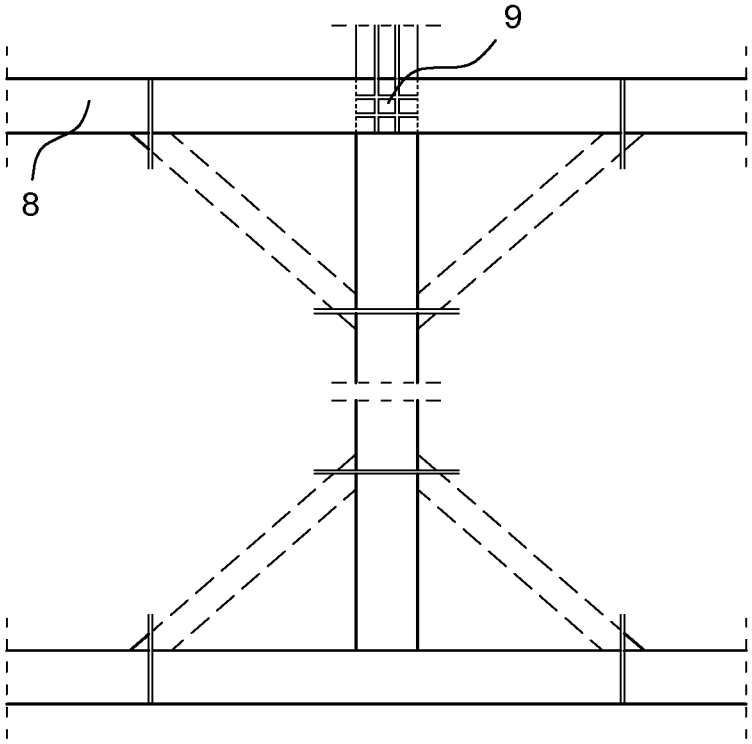
FIG. 5 illustrates beams being posed to form upper ring beam, in accordance with an exemplary embodiment of the present disclosure.

FIG. 5 represents beams being posed to form upper ring beam.

FIG. 5 describes a beam (8), as well as the junction's reinforcement (9) constituted by starting bars of the left beam, those of the right beam and those of the end top of the column.

Figure 6:
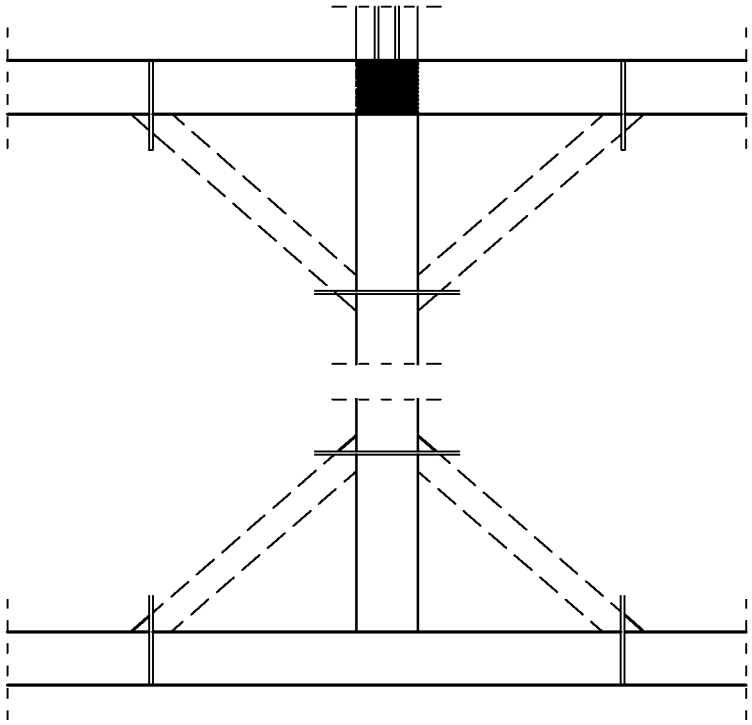
FIG. 6 illustrates same elements as the FIG. 5, but after concrete has been cast into the junction, when the realization of the junction is finished, in accordance with an exemplary embodiment of the present disclosure.

FIG. 6 shows same elements as the previous figure, but after concrete has been cast into the junction: thus the realization of the junction is finished.

Figure 7:
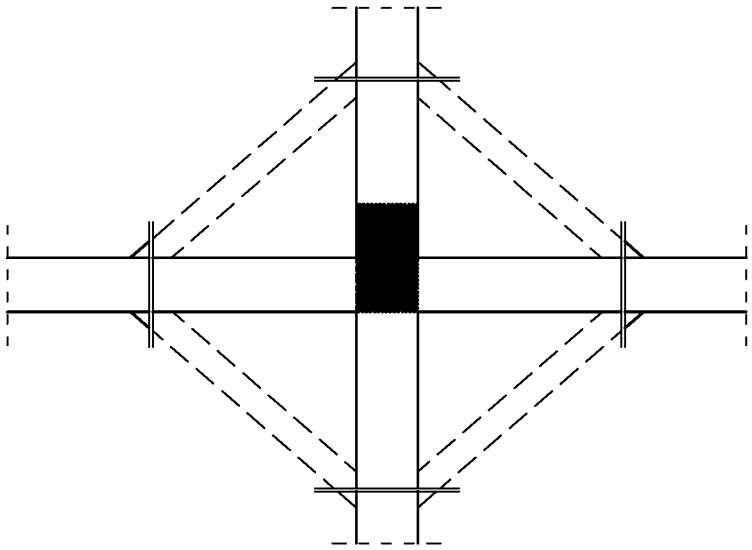
FIG. 7 illustrates section view of the whole set of the junctions in a construction node, where on site casted areas are highlighted, in accordance with an exemplary embodiment of the present disclosure.

FIG. 7 section view of the whole set of the junctions in a construction node, where on site casted areas are highlighted.

Figure 8:
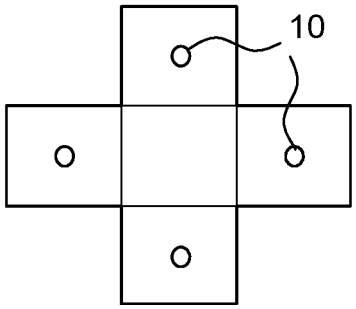
FIG. 8 illustrates a prefabricated junction block for the junction of columns and beams adjacent to the node, in case of total prefabrication, in accordance with an exemplary embodiment of the present disclosure.

FIG. 8 represents a prefabricated junction block for the junction of columns and beams adjacent to the node, in case of total prefabrication.

FIG. 8 describes two branches for the junction of two columns, and two branches for the junction of two beams, as well as pre-holes (10) where assembling rods will go through.

Figure 9:
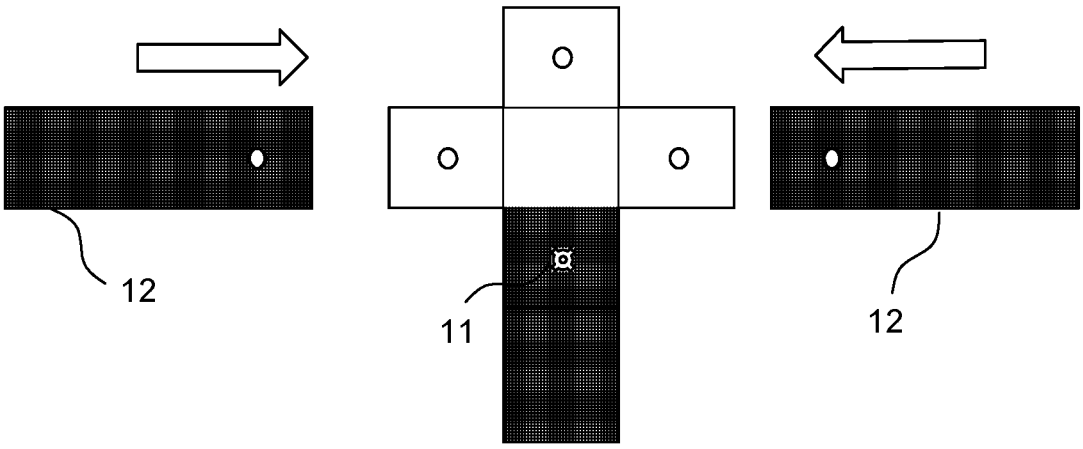
FIG. 9 illustrates a junction block already fixed to a column, in accordance with an exemplary embodiment of the present disclosure.

FIG. 9 represents a junction block already fixed to a column.

FIG. 9 describes assembling rod (11), and two beams (12) waiting to be fixed to the block.

Figure 10:
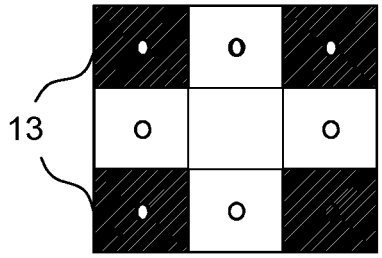
FIG. 10 illustrate represents an enlarged junction block, in accordance with an exemplary embodiment of the present disclosure.

FIG. 10 represents an enlarged junction block.

FIG. 10 describes areas of the junction block enlarged to corners of adjacent walls and floors (13).

Figure 11:
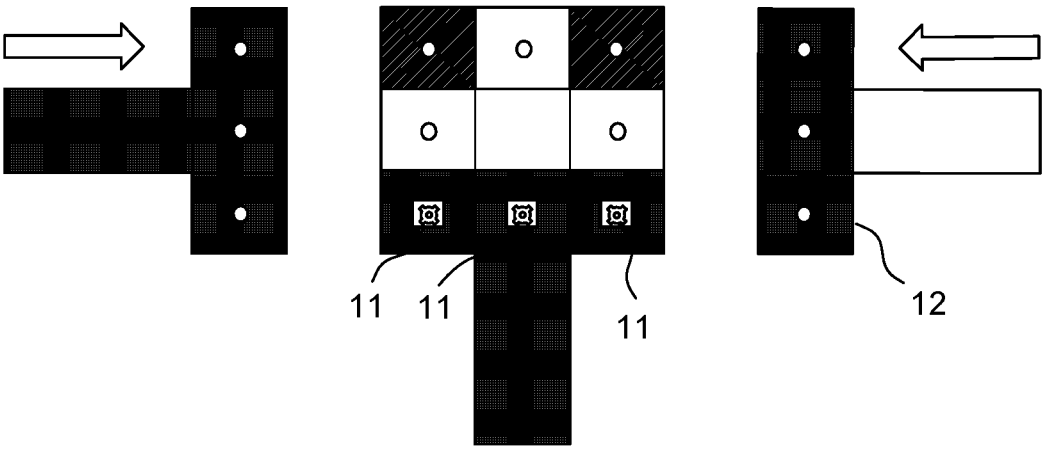
FIG. 11 illustrates an enlarged junction block already fixed to a column, in accordance with an exemplary embodiment of the present disclosure.

FIG. 11 represents an enlarged junction block already fixed to a column.

FIG. 11 describes three assembling rods (11), and two beams (12) waiting to be fixed onto the block.

In one embodiment, the building structure includes at least one peripheral junction, at least one central junction and a plurality of walls and floors. The at least one peripheral junction is formed by prefabricated columns and beams connected via braces and rods. Further, the at least one central junction is formed by one of prefabricated metallic frames and/or prefabricated connection blocks connected along the end portion of each of the columns and beams. As shown in FIGS. 10 and 11, the at least one central junction may include at least one enlarged section (13) configured along corner portions of the central junction. Furthermore, the plurality of walls and floors are configured and supported via the at least one peripheral junction and the at least one central junction. Each of the walls and floors of the plurality of walls and floors includes corners. The enlarged section (13) is configured along at least one of a corner portions of the central junction coincides with the corners of each of the walls and floors of the plurality of walls and floors.

In one embodiment, at least one central junction may include a central portion having four sides, and a peripheral portion extending from all the four sides, wherein each of the peripheral portion and the central portion comprises at least one hole. Further, the at least one enlarged section (13) may extend between the two adjacent peripheral portions, wherein each of the at least one enlarged section (13) also comprises at least one hole. Furthermore, the holes of the enlarged section (13), the central and the peripheral portions cooperate with respective corresponding holes of the columns and beams, and the walls and floors.

In one embodiment, the building structure may include assembling rods (12) to engage with the cooperated holes of the enlarged section (13), central and peripheral portions cooperate with respective corresponding holes of the columns and beams, and the walls and floors.

Figure 12:
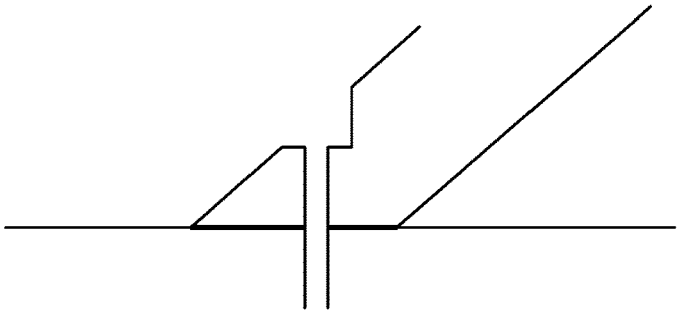
FIG. 12 illustrates a section of a junction beam—brace, in accordance with an exemplary embodiment of the present disclosure.

FIG. 12 represents a section of a junction beam—brace. No special provision has been taken in the contact area. If there is a force which tends to open or close the angle made of column and beam, the brace will play its role by opposing itself against this action. The assembling threaded rod will be subject to shearing forces and accordingly, must be of great section.

Figure 13:
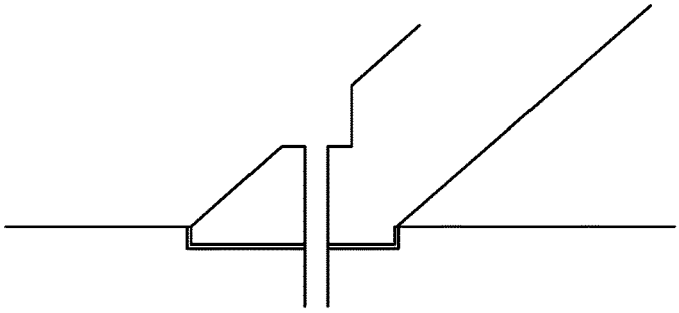
FIG. 13 illustrates a section of the same junction beam-brace, where a notch has been provided in the beam, in accordance with an exemplary embodiment of the present disclosure.

FIG. 13 represents a section of the same junction beam-brace, where a notch has been provided in the beam, for receiving a wedge provided at the end of the brace, in order to avoid so the brace could slide along the beam, and shearing forces which would then result in the assembling rod.

Figure 14:
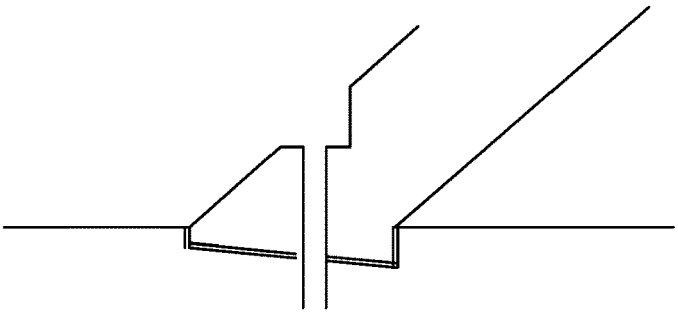
FIG. 14 illustrates a section of the same junction beam-brace, where the inner notch is longer than the outer one, in accordance with an exemplary embodiment of the present disclosure.

FIG. 14 represents a section of the same junction beam-brace, where the inner notch is longer than the outer one.

Figure 15:
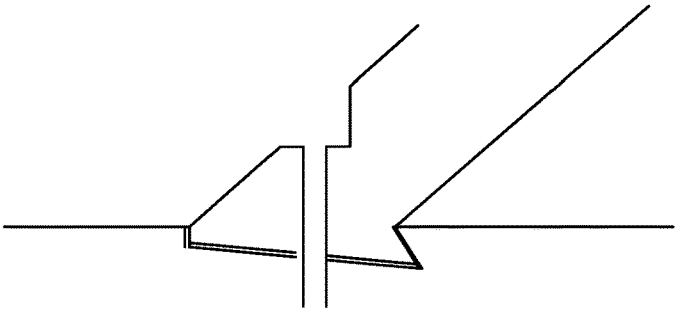
FIG. 15 illustrates a section of the same junction beam-brace, where the notch provided in the column or in the beam has an angle inferior to 90°, in accordance with an exemplary embodiment of the present disclosure.

FIG. 15 represents a section of the same junction beam-brace, where the notch provided in the column or in the beam has an angle inferior to 90°.

Figure 16:
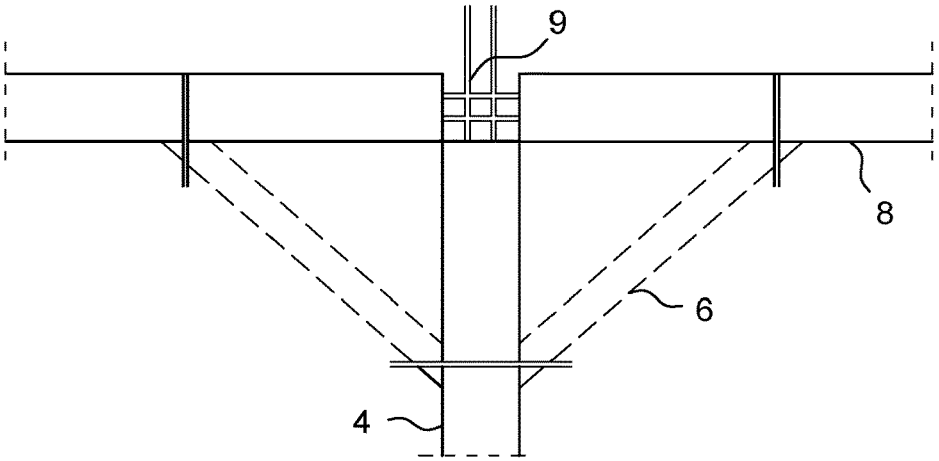
FIG. 16 illustrates a sectional view of junction model for the construction, in accordance with an exemplary embodiment of the present disclosure.

FIG. 16 represents a sectional view of junction model for the construction.

FIG. 16 describes the column (4), a beam ((8), a brace (6), and the junction reinforcement (9).

Figure 17:
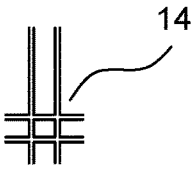
FIG. 17 illustrates a sectional view of a prefabricated reinforcement of the junction, in accordance with an exemplary embodiment of the present disclosure.

FIG. 17 represents a sectional view of a prefabricated reinforcement of the junction.

FIG. 17 describes the junction prefabricated reinforcement (14).

Figure 18:
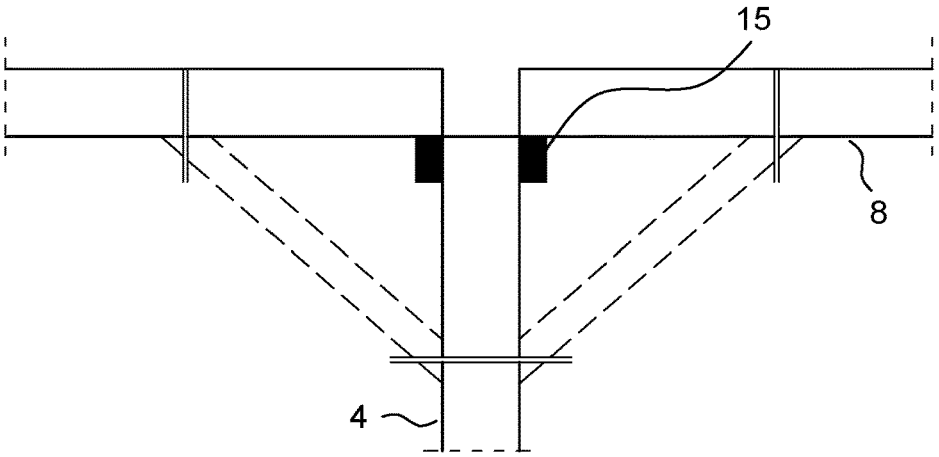
FIG. 18 illustrates a sectional view of a model of a construction nod, before prefabricated reinforcement being posed, in accordance with an exemplary embodiment of the present disclosure.

FIG. 18 represents a sectional view of a model of a construction nod, before prefabricated reinforcement being posed.

FIG. 18 describes the column (4), a beam (8), and the removable intermediate support (15).

Figure 19:
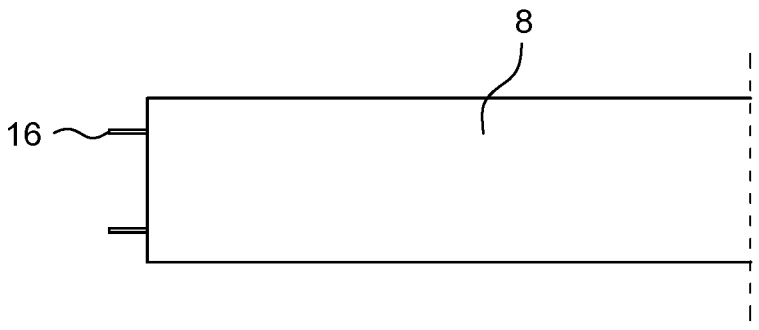
FIG. 19 illustrates details of a beam end in case of prefabricated reinforcement, in accordance with an exemplary embodiment of the present disclosure.

FIG. 19 represents details of a beam end in case of prefabricated reinforcement.

FIG. 19 describes the beam (8), as well as the ends of starting bars on which the prefabricated reinforcement will be welded (16).

Figure 20:
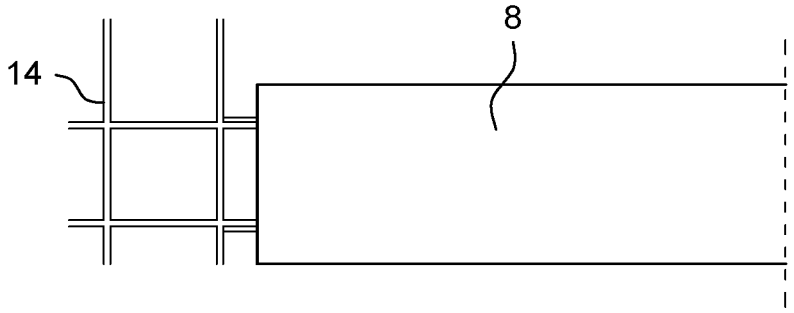
FIG. 20 illustrates how the prefabricated reinforcement is connected to the beams, in accordance with an exemplary embodiment of the present disclosure.

FIG. 20 represents how the prefabricated reinforcement is connected to the beams.

FIG. 20 describes a beam (8), and the prefabricated reinforcement (14).

(E) BEST MODE FOR CARRYING OUT THE INVENTION

The best mode for carrying out the invention is described hereafter:

1) Factory prefabrication for all columns, beams and braces.

At the columns and beams ends, we provide short starting bars of about 4 cm long, on which prefabricated reinforcements will be welded (FIG. 19/20).

On the other hand, columns will be provided with starting bars of about 20 cm long at the bottom ends, and starting bars of about 40 cm long at the top ends (FIG. 2/20).

2) Construction of a classic foundation for a reinforced concrete construction.

Starting bars are provided for connecting future columns (FIG. 1/20).

3) Installation of the columns of the first level of the building.

Starting bars of the columns intersect with the ones provided in the foundation.

The columns are held upright by braces connecting said columns to the low ring beam (FIG. 3/20).

Horizontal braces joining beams of low ring beam are fixed.

After the control of the verticality of the columns, formwork is posed and concrete is cast in this area of the columns.

As columns and beams are securely held in their final position by braces, construction work can be carried out shortly after concrete has been cast in the junctions, or even before the said casting.

4) Posing beams that form the upper ring beam of the construction level.

For this purpose, removable intermediate supports are fixed at the lateral top end of columns, and then beams, and then braces (FIG. 18/20).

After vertical and horizontal braces have been fixed, then removable intermediate supports are removed and construction work can go on.

5) Fixing the prefabricated reinforcements for junctions.

The prefabricated reinforcements are welded to starting bars of columns and beams (FIG. 20/20). Formwork is then carried out where necessary, i.e. in the nodes with only two or three beams, bearing in mind that the ends of columns and beams form a formwork, and then the concrete is cast in the junction.

6) Floor is built, and then we start step 3 for further construction of the following floor.

It should be noted that it is possible to cast concrete in the junctions once for all, at the end of the construction of the whole structure.

(F) INDUSTRIAL APPLICABILITY

The primary purpose of the invention is advanced prefabrication of the structure for columns—beams construction type, said prefabrication resulting in industrialization of this type of construction. The main development that allows this achievement in the same technical conditions, even in better conditions than by the conventional system, is the massive use of braces as well vertically as horizontally.

They realize a strong peripheral junction connecting the columns and beams on one hand, and the beams between them on the other hand.

The central junction, which takes place at the intersection between columns and beams, can be performed on site or prefabricated, and therefore industrialized, or at least highly standardized.

Be it central junctions are concrete casted on site or factory prefabricated as junction blocks, everything is practically done in the factory, with according benefits: standardization of the production, quality and speed of execution, reduction costs and construction time. In addition, the weight of the building will reduced, too, because for the same resistance to vertical and horizontal loads, this grid like modular structure is lighter than a conventional structure.

The main constraint of the system is that braces occupy the axis wall for greater efficiency, which prevents or reduces the use of traditional materials in the construction of the walls such as bricks and blocks of all kinds.

But this will push developers to adopt more often walls suitable for this type of structure, such as the panels currently used in wood construction.

Finally this constraint will be widely offset by the large number of additional benefits that will result from the use of lightweight walls, to the point that one could even speak of multiplication effect in terms of weight reduction, cost and speed of realization of the construction.

Such building system is of special interest for high seismic risk areas, because the building is lightweight, constituted of a set of structurally self-sufficient units, heavily triangulated and therefore hardly deformable, all these at a relatively modest cost.

What is claimed is:

1. A method for construction of a concrete building structure, comprising:

prefabricating a plurality of columns and beams, and a plurality of braces, at a factory site, wherein each column and beam of the plurality of columns and beams, comprise, a plurality of starting bars or a connector assembly along at least one end portion of each of the column and beam;

assembling a double junction between columns and beams, wherein assembling the double junction comprises, assembling a peripheral junction by connecting the columns to adjacent beams, and the plurality of braces to adjacent beams, assembling a central junction of reinforced concrete, at an intersection between columns and beams along the respective end portions thereof with the plurality of starting bars or the connector assembly, the central junction comprises a plurality of prefabricated metallic frames or connection blocks for reinforcement of the central junction, the prefabricated metallic frames to be welded with the starting bars of the beams, or the connector assembly to be connected with the connection blocks, while the columns bottoms with respective starting bars respective ends thereof or the columns bottoms with the connector assembly to be connected with the connection blocks for assembling with a foundation or with the columns of a lower floor of the building, pouring concrete in the central junctions and along the bottom of the columns of one or more floors, while the prefabricated columns and beams along the peripheral junction, and, the metallic frames welded along the central junction, on the construction site held the building structure, and configuring and supporting a plurality of walls and floors via the at least one peripheral junction and the at least one central junction, wherein each of the walls and floors of the plurality of walls and floors having corners.

2. The method as claimed in claim 1, wherein the at least one enlarged section is configured along at least one of a corner portions of the central junction coincides with the corners of each of the walls and floors of the plurality of walls and floors.

3. The method as claimed in claim 2, wherein at least one central junction comprises a central portion having a plurality of sides, and a peripheral portion extending from the plurality of sides, wherein each of the peripheral portion and the central portion comprises at least one hole.

4. The method as claimed in claim 3, wherein at least one enlarged section extends between the two adjacent peripheral portions, wherein each of the at least one enlarged section also comprises at least one hole.

5. The method as claimed in claim 4, wherein the holes of the enlarged section, central and peripheral portions cooperate with respective corresponding holes of the columns and beams, and the walls and floors.

6. The method as claimed in claim 5 further comprising engaging assembling rods with the cooperated holes of the enlarged section, central and peripheral portions cooperate with respective corresponding holes of the columns and beams, and the walls and floors.

7. A method for construction of a concrete building structure, comprising:

assembling at least one peripheral connection by connecting prefabricated columns and beams via braces and rods, wherein each of the columns and beams comprises prefabricated holes along each of the column and beam, and, wherein each of braces comprise prefabricated holes to concede with the prefabricated holes of the beams and the columns, and assembling at least one central connection at intersection of the columns and beams by welding prefabricated metallic frames to starting bars of columns and beams or prefabricated reinforced concrete connection blocks along the end portion of each of the columns and beams, wherein at least one peripheral connection is assembled around the at least one central connection while the central connection is still under construction.

8. The method as claimed in claim 7, wherein at least one central connection comprises;

a reinforced concrete connecting block with a central portion having a plurality of sides, and peripheral portions corresponding to columns and beams contiguous to the central connection and extending from the central portion along all the plurality of sides, wherein each of the peripheral portions comprises at least one prefabricated hole.

9. A concrete building structure comprising:

at least one peripheral connection formed by prefabricated columns and beams connected via braces and rods, wherein each of the columns and beams comprises prefabricated holes along each of the column and beam, and, wherein each of braces comprise prefabricated holes to concede with the prefabricated holes of the beams and the columns; and at least one reinforced concrete central connection at intersection of the columns and beams formed by prefabricated metallic frames welded to starting bars of columns and beams or prefabricated reinforced concrete connection blocks connected along the end portion of each of the columns and beams, wherein at least one peripheral connection is assembled around the at least one central connection while the central connection is still under construction.

10. The concrete building structure as claimed in claim 9, wherein at least one central connection comprises;

a reinforced concrete connecting block with a central portion having a plurality of sides, and peripheral portions corresponding to the columns and beams contiguous to the central connection and extending from the central portion along the plurality of sides, wherein each of the peripheral portions comprises at least one hole.

* * * * *